US006397859B1

(12) United States Patent
Byrd

(10) Patent No.: US 6,397,859 B1
(45) Date of Patent: Jun. 4, 2002

(54) TOOTHBRUSH ASSEMBLY

(76) Inventor: Shelby Byrd, 9375 Strawberry Plains Park, Strawberry Plains, TN (US) 37871

( * ) Notice: Subject to any disclaimer, the term of this patent is extended or adjusted under 35 U.S.C. 154(b) by 0 days.

(21) Appl. No.: 09/944,028

(22) Filed: Aug. 31, 2001

(51) Int. Cl.[7] ..... A45D 44/18; A46B 11/00; A46B 9/04

(52) U.S. Cl. ..... 132/308; 132/311; 15/167.1

(58) Field of Search ..... 132/308, 311; 401/176, 177, 171, 179; 433/80, 89; 15/167.1

(56) References Cited

U.S. PATENT DOCUMENTS

| | | | | | |
|---|---|---|---|---|---|
| 910,970 | A | | 1/1909 | Stryker | |
| 1,212,010 | A | | 1/1917 | Brown | |
| 2,033,197 | A | | 3/1936 | Kinkade | |
| 2,243,774 | A | | 5/1941 | Resh | |
| 2,274,790 | A | | 3/1942 | Housley | |
| 4,277,194 | A | * | 7/1981 | Smith | 401/173 |
| 4,622,984 | A | * | 11/1986 | Gaebel | 132/308 |
| 4,655,627 | A | * | 4/1987 | Bradley | 401/175 |
| 5,066,155 | A | * | 11/1991 | English | 401/175 |
| 5,425,590 | A | | 6/1995 | Duty et al. | |
| 5,584,593 | A | | 12/1996 | Lafortune | |
| 5,599,126 | A | | 2/1997 | Hough | |
| 5,636,933 | A | * | 6/1997 | Vizsolyi | 401/269 |
| 5,737,792 | A | | 4/1998 | Quigless | |
| 6,039,050 | A | | 3/2000 | Goldenberg | |
| 6,056,466 | A | * | 5/2000 | Johnson | 401/188 |
| 6,105,587 | A | | 8/2000 | Dunn | |
| 6,213,662 | B1 | * | 4/2001 | Aljanedi | 401/175 |
| 6,213,663 | B1 | * | 4/2001 | Micaletti et al. | 401/176 |

* cited by examiner

*Primary Examiner*—John J. Wilson
*Assistant Examiner*—Robyn Kieu Doan

(57) ABSTRACT

A toothbrush assembly for providing a toothbrush having toothpaste therein for a single use. The toothbrush assembly includes a tubular member which is elongated and has an open end and a closed end. A bore extends into the open end toward the closed end. The tubular member has a proximal portion, a middle portion and a distal portion with respect to the closed end of the tubular member. The proximal portion has an outer surface having a plurality of bristles attached thereto. The proximal portion has a hole therein extending into the bore. A plunger is elongated and has a first end and a second end. The plunger has a length and width substantially equal to a length and width of the bore. The first end of the plunger is extendable into the bore. A retaining means retains the plunger in the bore. Toothpaste is positioned in the bore and the plunger may be selectively extended into the bore such that the toothpaste is extracted through the hole.

7 Claims, 4 Drawing Sheets

TOOTHBRUSH ASSEMBLY

BACKGROUND OF THE INVENTION

1. Field of the Invention

The present invention relates to disposable toothbrushes and more particularly pertains to a new toothbrush assembly for providing a toothbrush having toothpaste therein for a single use.

2. Description of the Prior Art

The use of disposable toothbrushes is known in the prior art. More specifically, disposable toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 910,970; U.S. Pat. No. 1,212,010; U.S. Pat. No. 2,033,197; U.S. Pat. No. 2,243,774; U.S. Pat. No. 2,274,790; U.S. Pat. No. 4,655,627; U.S. Pat. No. 5,425,590; U.S. Pat. No. 5,584,593; U.S. Pat. No. 5,599,126; U.S. Pat. No. 5,737,792; U.S. Pat. No. 6,039,050; and U.S. Pat. No. 6,105,587.

While these devices fulfill their respective, particular objectives and requirements, the aforementioned patents do not disclose a new toothbrush assembly. The inventive device includes a tubular member which is elongated and has an open end and a closed end. A bore extends into the open end toward the closed end. The tubular member has a proximal portion, a middle portion and a distal portion with respect to the closed end of the tubular member. The proximal portion has an outer surface having a plurality of bristles attached thereto. The proximal portion has a hole therein extending into the bore. A plunger is elongated and has a first end and a second end. The plunger has a length and width substantially equal to a length and width of the bore. The first end of the plunger is extendable into the bore. A retaining means retains the plunger in the bore. Toothpaste is positioned in the bore and the plunger may be selectively extended into the bore such that the toothpaste is extracted through the hole.

In these respects, the toothbrush assembly according to the present invention substantially departs from the conventional concepts and designs of the prior art, and in so doing provides an apparatus primarily developed for the purpose of providing a toothbrush having toothpaste therein for a single use.

SUMMARY OF THE INVENTION

In view of the foregoing disadvantages inherent in the known types of disposable toothbrushes now present in the prior art, the present invention provides a new toothbrush assembly construction wherein the same can be utilized for providing a toothbrush having toothpaste therein for a single use.

The general purpose of the present invention, which will be described subsequently in greater detail, is to provide a new toothbrush assembly apparatus and method which has many of the advantages of the disposable toothbrushes mentioned heretofore and many novel features that result in a new toothbrush assembly which is not anticipated, rendered obvious, suggested, or even implied by any of the prior art disposable toothbrushes, either alone or in any combination thereof.

To attain this, the present invention generally comprises a tubular member which is elongated and has an open end and a closed end. A bore extends into the open end toward the closed end. The tubular member has a proximal portion, a middle portion and a distal portion with respect to the closed end of the tubular member. The proximal portion has an outer surface having a plurality of bristles attached thereto. The proximal portion has a hole therein extending into the bore. A plunger is elongated and has a first end and a second end. The plunger has a length and width substantially equal to a length and width of the bore. The first end of the plunger is extendable into the bore. A retaining means retains the plunger in the bore. Toothpaste is positioned in the bore and the plunger may be selectively extended into the bore such that the toothpaste is extracted through the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothbrush assembly apparatus and method which has many of the advantages of the disposable toothbrushes mentioned heretofore and many novel features that result in a new toothbrush assembly which is not anticipated, rendered obvious, suggested, or even implied by any of the prior art disposable toothbrushes, either alone or in any combination thereof.

It is another object of the present invention to provide a new toothbrush assembly which may be easily and efficiently manufactured and marketed.

It is a further object of the present invention to provide a new toothbrush assembly which is of a durable and reliable construction.

An even further object of the present invention is to provide a new toothbrush assembly which is susceptible of a low cost of manufacture with regard to both materials and labor, and which accordingly is then susceptible of low prices of sale to the consuming public, thereby making such toothbrush assembly economically available to the buying public.

Still yet another object of the present invention is to provide a new toothbrush assembly which provides in the apparatuses and methods of the prior art some of the advantages thereof, while simultaneously overcoming some of the disadvantages normally associated therewith.

Still another object of the present invention is to provide a new toothbrush assembly for providing a toothbrush having toothpaste therein for a single use.

Yet another object of the present invention is to provide a new toothbrush assembly which includes a tubular member which is elongated and has an open end and a closed end. A bore extends into the open end toward the closed end. The tubular member has a proximal portion, a middle portion and a distal portion with respect to the closed end of the tubular member. The proximal portion has an outer surface having a plurality of bristles attached thereto. The proximal portion has a hole therein extending into the bore. A plunger is elongated and has a first end and a second end. The plunger has a length and width substantially equal to a length and width of the bore. The first end of the plunger is extendable into the bore. A retaining means retains the plunger in the bore. Toothpaste is positioned in the bore and the plunger may be selectively extended into the bore such that the toothpaste is extracted through the hole.

Still yet another object of the present invention is to provide a new toothbrush assembly that has a plunger which includes a retaining means such that the plunger may not be removed and the device refilled with toothpaste. This feature also prevents accidental discharge of the toothpaste through the hole as a relatively large amount of pressure must be placed on the plunger to move the catch out of the notch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
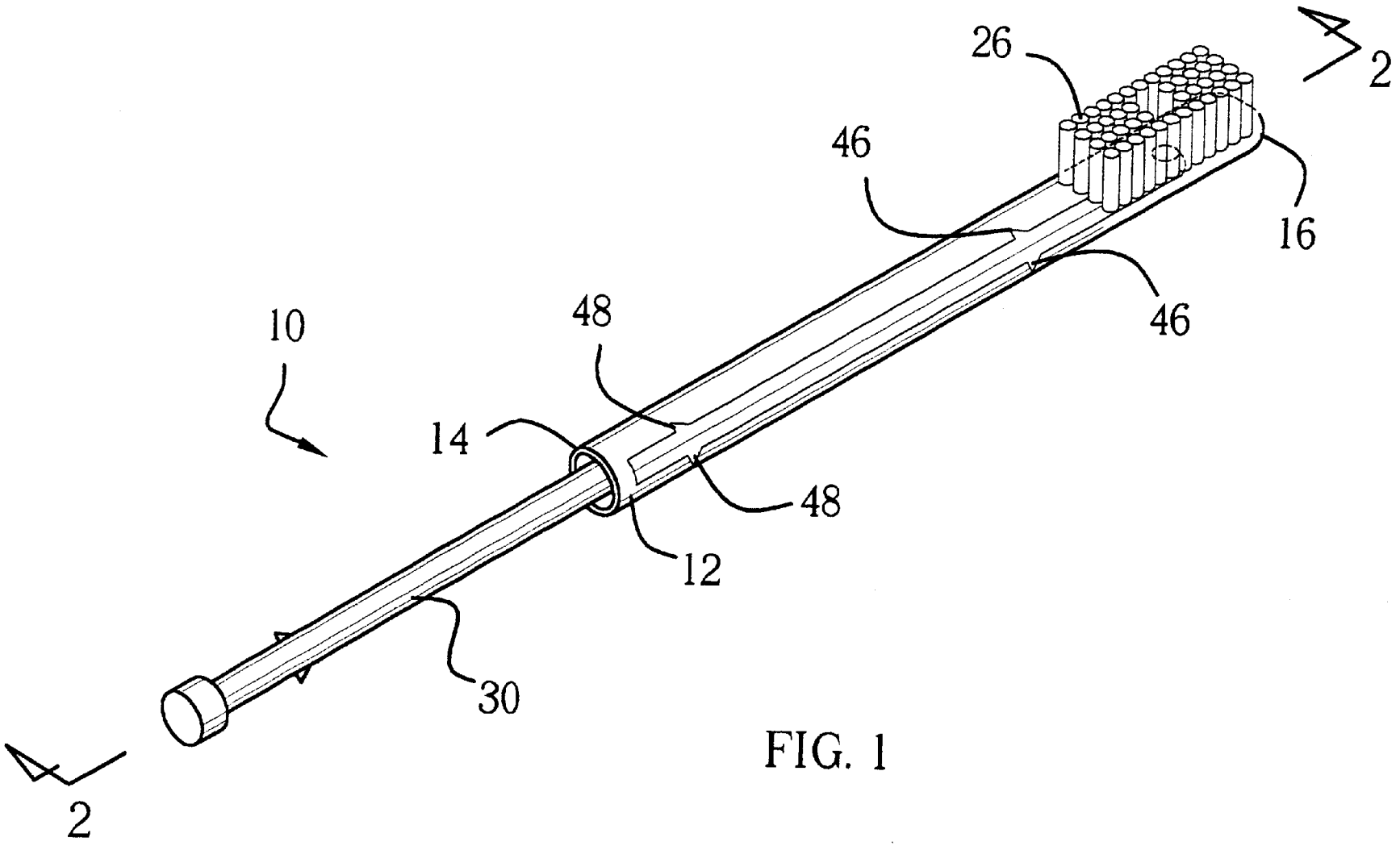
FIG. 1 is a schematic perspective view of a new toothbrush assembly according to the present invention.
Figure 2:
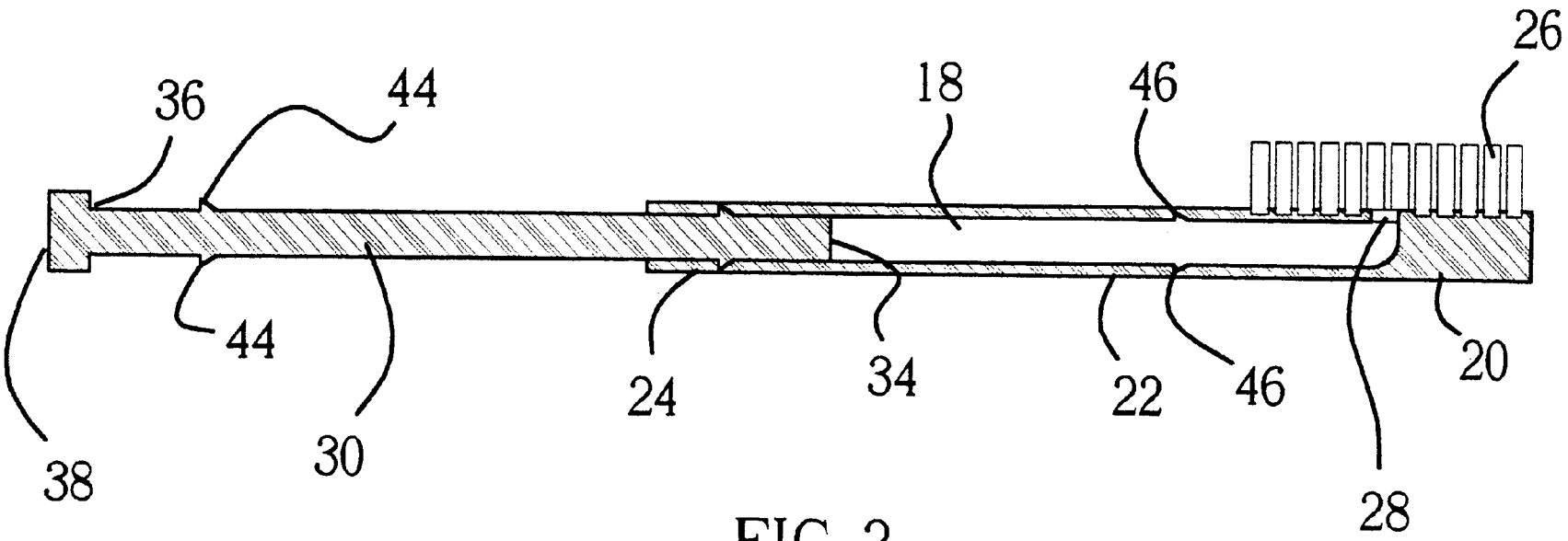
FIG. 2 is a schematic cross-sectional view taken along line 2—2 of FIG. 1 of the present invention.

With reference now to the drawings, and in particular to FIGS. 1 through 4 thereof, a new toothbrush assembly embodying the principles and concepts of the present invention and generally designated by the reference numeral 10 will be described.

As best illustrated in FIGS. 1 through 4, the toothbrush assembly 10 generally comprises a tubular member 12 which is elongated and has an open end 14 and a closed end 16 such that a bore 18 is defined extending into the open end 14 toward the closed end 16. The tubular member 12 has a proximal portion 20, a middle portion 22 and a distal portion 24 with respect to the closed end 16 of the tubular member 12. The proximal portion 20 has an outer surface having a plurality of bristles 26 attached thereto. The bristles 26 extend in generally the same direction away from the tubular member. The bristles 26 are preferably orientated generally perpendicular to a longitudinal axis of the tubular member 12. The proximal portion 20 has a hole 28 therein extending into the bore 18. The hole 28 is disposed in the bristles 26 such that the bristles 28 generally encompass the hole 28.

A plunger 30 is elongated and has a first end 34 and a second end 36. The plunger 30 has a length and width substantially equal to a length and width of the bore 18. The first end 34 of the plunger 30 is extendable into the bore 18. A handle 38 is attached to the second end 36 of the plunger 30.

Figure 3:
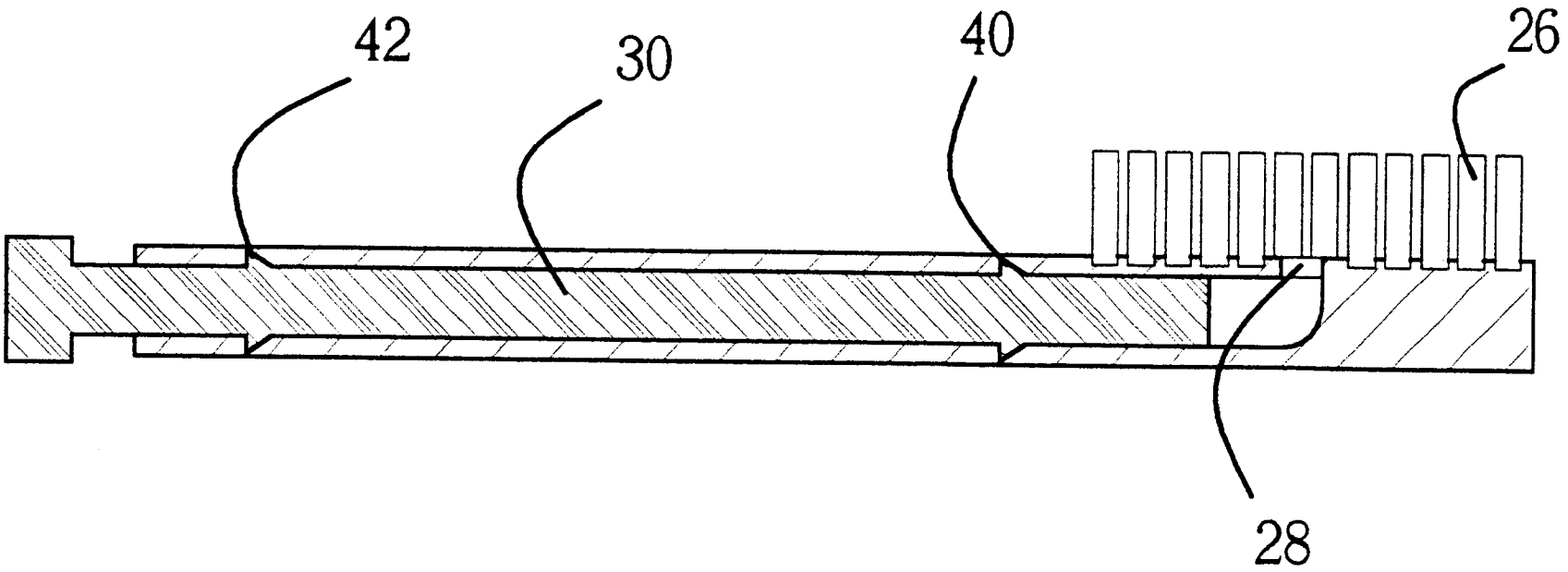
FIG. 3 is a schematic cross-sectional view of the present invention.
Figure 4:
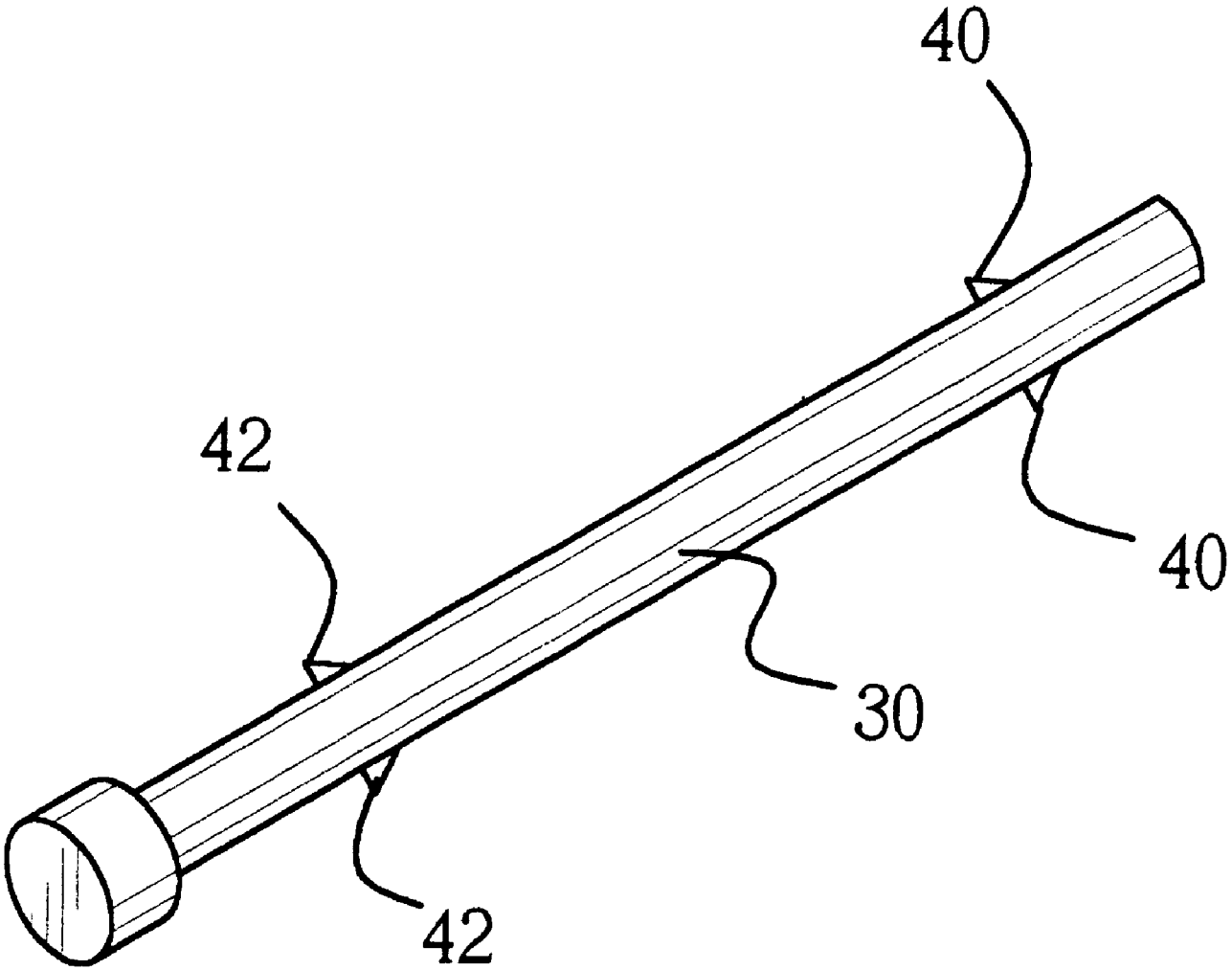
FIG. 4 is a schematic perspective view of the plunger of the present invention.

A retaining means for retaining the plunger 30 in the bore 18 includes a first set of catches 40 attached to the plunger 30 and positioned nearer the first end 34 than the second end 36 of the plunger 30. A second set of catches 42 is attached to the plunger 30 and is positioned nearer the second end 36 than the first end 34. Each of the catches 40, 42 comprises an upstanding member having an edge 44 facing the first end 34 and angled downward to the plunger 30. The bore 18 has a first set of notches 46 therein positioned nearer the closed end 16 and a second set of notches 48 positioned nearer the open end 14. The notches 46, 48 are positioned such that the first set of catches 40 is positioned in the first set of notches 46 and the second set of catches 42 is positioned in the second set of notches 48 when the plunger 30 is fully extended in the bore 18 as depicted in FIG. 3. Each of the notches 46, 48 has a shape substantially identical to the catches 40, 42 such that the catches 40, 42 may not move past the notches 46, 48 toward the open end 14. Ideally the catches 40, 42 are comprised of a resiliently compressible material.

In use, toothpaste is positioned in the bore 18 between the hole 28 and the second notches 48 and the first catches 42 are positioned in the second notches 48 such that the toothpaste is retained in the bore 18. The plunger 30 may be selectively extended into the bore 18 and the first catches 42 are positioned in the first notches 46 such that the toothpaste is extracted through the hole 28. The first notches 46 prevent the plunger 30 from moving away from the hole 28 such that the bore 18 may not be refilled with toothpaste. The second notches 48 prevent the plunger 30 from being removed from the tubular member 12 when the bore 18 is filled with toothpaste. This retains the toothpaste in the bore 18 while preventing children or others from removing the plunger 30 from the tubular member 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable toothbrush and toothpaste applicator combination comprising:

a tubular member being elongated and having an open end and a closed end such that a bore extends into said open end toward said closed end, said tubular member having a proximal portion, a middle portion and a distal portion with respect to said closed end of said tubular member, said proximal portion having an outer surface having a plurality of bristles attached thereto, said proximal portion having a hole therein extending into said bore;

a plunger being elongated and having a first end and a second end, said plunger having a length and width substantially equal to a length and width of said bore, said first end of said plunger being extendable into said bore;

a retaining means for retaining said plunger in said bore such that said plunger is prevented from being pulled out of said bore;

wherein toothpaste is positioned in said bore and said plunger may be selectively extended into said bore such that the toothpaste is extracted through said hole; and wherein said retaining means includes a set of catches extending from said plunger and being positioned nearer said first end than said second end of said plunger, each catch of said set of catches comprising an upstanding member having a first face and a second face, said second face extending orthogonally outward from said plunger, said bore having a first set of notches therein positioned nearer said closed end and a second set of notches positioned nearer said open end, each said notch of said first and second sets of notches having a notch face oriented perpendicularly to a longitudinal axis of said bore for engaging said second face of an associated one of said set of notches when said set of notches are positioned in one of said first and second set of catches whereby said plunger is prevented from being pulled in an outward direction from said bore when said set of notches is engaging one of said first and second set of catches.

2. The disposable toothbrush and toothpaste applicator combination of claim 1, further comprising:

each said first face extending outwardly from said plunger towards said second end at an acute angle for facilitating disengagement of said set of notches from said second set of catches to permit pushing said plunger into said bore whereby said toothpaste is dispensed through said hole.

3. The disposable toothbrush and toothpaste applicator combination of claim 1, further comprising:

said set of catches being positioned to engage said first set of notches when said plunger is fully extended into said bore.

4. The disposable toothbrush and toothpaste applicator combination of claim 1, further comprising:

said set of catches being a first set of catches;

a second set of catches extending from said plunger, said second set of catches being positioned to engage said second set of notches when said first set of catches is engaged to said first set of notches.

5. The disposable toothbrush and toothpaste applicator combination of claim 4, further comprising:

each catch of said second set of catches having a shape identical to said catches of said first set of catches whereby said second set of catches also prevents pulling said plunger outwardly from said bore when said second set of catches engages said second set of notches.

6. The disposable toothbrush and toothpaste applicator combination of claim 4, further comprising:

a first wall surface portion of said bore extending between said first and second sets of notches being smooth for preventing catching of said first set of catches along said first wall surface portion as said plunger is pushed into said bore; and a second wall surface of said bore extending between said second set of notches and said open end of said tubular member for preventing catching of said second set of catches along said wall surface of said bore extending between said second set of notches and said open end of said tubular member as said plunger is pushed into said bore.

7. A disposable toothbrush and toothpaste applicator combination comprising:

a tubular member being elongated and having an open end and a closed end such that a bore extends into said open end toward said closed end, said tubular member having a proximal portion, a middle portion and a distal portion with respect to said closed end of said tubular member, said proximal portion having an outer surface having a plurality of bristles attached thereto, said proximal portion having a hole therein extending into said bore;

a plunger being elongated and having a first end and a second end, said plunger having a length and width substantially equal to a length and width of said bore, said first end of said plunger being extendable into said bore;

a retaining means for retaining said plunger in said bore such that said plunger is prevented from being pulled out of said bore;

wherein toothpaste is positioned in said bore and said plunger may be selectively extended into said bore such that the toothpaste is extracted through said hole;

wherein said retaining means includes a set of catches extending from said plunger and being positioned nearer said first end than said second end of said plunger, each catch of said set of catches comprising an upstanding member having a first face and a second face, said second face extending orthogonally outward from said plunger, said bore having a first set of notches therein positioned nearer said closed end and a second set of notches positioned nearer said open end, each said notch of said first and second sets of notches having a notch face oriented perpendicularly to a longitudinal axis of said bore for engaging said second face of an associated one of said set of notches when said set of notches are positioned in one of said first and second set of catches whereby said plunger is prevented from being pulled in an outward direction from said bore when said set of notches is engaging one of said first and second set of catches;

each said first face extending outwardly from said plunger towards said second end at an acute angle for facilitating disengagement of said set of notches from said second set of catches to permit pushing said plunger into said bore whereby said toothpaste is dispensed through said hole;

said set of catches being positioned to engage said first set of notches when said plunger is fully extended into said bore;

said set of catches being a first set of catches;

a second set of catches extending from said plunger, said second set of catches being positioned to engage said second set of notches when said first set of catches is engaged to said first set of notches;

each catch of said second set of catches having a shape identical to said catches of said first set of catches whereby said second set of catches also prevents pulling said plunger outwardly from said bore when said second set of catches engages said second set of notches;

a first wall surface portion of said bore extending between said first and second sets of notches being smooth for preventing catching of said first set of catches along said first wall surface portion as said plunger is pushed into said bore; and a second wall surface of said bore extending between said second set of notches and said open end of said tubular member for preventing catching of said second set of catches along said wall surface of said bore extending between said second set of notches and said open end of said tubular member as said plunger is pushed into said bore.

* * * * *